US006964438B2

(12) United States Patent
Koike et al.

(10) Patent No.: US 6,964,438 B2
(45) Date of Patent: Nov. 15, 2005

(54) DOOR LOCK DEVICE FOR A VEHICLE

(75) Inventors: Tsuneyuki Koike, Anjo (JP); Toshio Machida, Toyota (JP); Toshitsugu Oda, Okazaki (JP); Shinsuke Takayanagi, Aichi-ken (JP)

(73) Assignees: Aisin Seiki Kabushiki Kaisha, Kariya (JP); Aisin Kiko Co., Ltd., Aichi-Ken (JP)

( * ) Notice: Subject to any disclaimer, the term of this patent is extended or adjusted under 35 U.S.C. 154(b) by 0 days.

(21) Appl. No.: 10/779,670

(22) Filed: Feb. 18, 2004

(65) Prior Publication Data

US 2004/0227355 A1 Nov. 18, 2004

(30) Foreign Application Priority Data

Feb. 18, 2003 (JP) ..... 2003-039999

(51) Int. Cl.[7] ..... E05C 3/06
(52) U.S. Cl. ..... 292/201; 292/216
(58) Field of Search ..... 292/216, 201; 49/279, 280

(56) References Cited

U.S. PATENT DOCUMENTS

| | | | | |
|---|---|---|---|---|
| 5,180,198 | A * | 1/1993 | Nakamura et al. | 292/201 |
| 5,520,425 | A | 5/1996 | Dowling | |
| 5,667,260 | A * | 9/1997 | Weyerstall | 292/201 |
| 6,176,528 | B1 * | 1/2001 | Taga | 292/341.16 |
| 6,648,380 | B1 * | 11/2003 | Szablewski et al. | 292/201 |

* cited by examiner

*Primary Examiner*—Gary Estremsky
(74) *Attorney, Agent, or Firm*—Buchanan Ingersolll PC

(57) ABSTRACT

A vehicle door lock device includes a latch being rotatable between an open position in which the latch is disengageable from a strikes and a lock position in which the latch is prohibited to disengage from the striker, and an actuator for rotating the latch toward the lock position and including an operating portion engageable with an operated portion formed at the latch and a drive mechanism for moving the operating portion being in an engaged state with the operated portion along a predetermined path. The drive mechanism. includes a guide wall face arranged so as to face the operating portion and a biasing member for biasing the operating portion to be pressed against the guide wall face. The operating portion can be separated from the guide wall face by an external force greater than a biasing force of the biasing member.

6 Claims, 12 Drawing Sheets

DOOR LOCK DEVICE FOR A VEHICLE

This application is based on and claims priority under 35 U.S.C. § 119 with respect to Japanese Application No. 2003-039999 filed on Feb. 18, 2003, the entire contents of which are incorporated herein by reference.

FIELD OF THE INVENTION

The present invention generally relates to a door lock device of a vehicle.

BACKGROUND OF THE INVENTION

A known vehicle door lock device is disclosed in U.S. Pat. No. 5,520,425. According to an power closing door latch device disclosed in the above patent, the actuator for rotating a latch toward a lock position includes a pin (operating portion) engageable with an engaging projection (operated portion) formed on the latch and a drive mechanism for shifting the pin in an engaged state with the engaging projection along a predetermined path. The drive mechanism includes a slit-shaped guide groove for guiding the pin that is operated based on a rotation force of a rotating member via an arm and a lever to a fully locked position of the latch.

According to the power closing door latch device, a moving path of the pin is restricted by a slit of the guide groove, i.e. the guide groove (guide path) for permitting the lateral movement of the pin is pinched by both upper and lower sides. Therefore, if the rotating member is driven to rotate in a state in which an obstacle is positioned on the guide groove (for example the engaging projection of the latch is slightly positioned within the guide groove), the pin cannot avoid hitting against a tip portion of the engaging projection of the latch, thereby causing interference between the pin and the engaging portion of the latch. As a result, any of the arm supporting the pin, the lever rotatably supporting the arm, and a plate-shaped member on which the guide groove is formed may be damaged.

Thus, a need exists for a door lock device for a vehicle wherein a portion of parts are not easily damaged even if an operating portion is operated in a state in which an obstacle is positioned on a guide pass.

SUMMARY OF THE INVENTION

According to an aspect of the present invention, a door lock device for a vehicle includes a latch provided at one of a vehicle door and a vehicle-body and being rotatable between an open position in which the latch is disengageable from a striker provided at the other one of the vehicle door and the vehicle-body and a lock position in which the latch is prohibited to disengage from the striker, and an actuator for rotating the latch toward the lock position and including an operating portion engageable with an operated portion formed at the latch and a drive mechanism for moving the operating portion being in an engaged state with the operated portion along a predetermined path. The drive mechanism includes a guide wall face arranged so as to face the operating portion and a biasing member for biasing the operating portion to be pressed against the guide wall face. The operating portion can be separated from the guide wall face by an external force greater than a biasing force of the biasing member.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements.

DETAILED DESCRIPTION OF THE INVENTION

Figure 1:
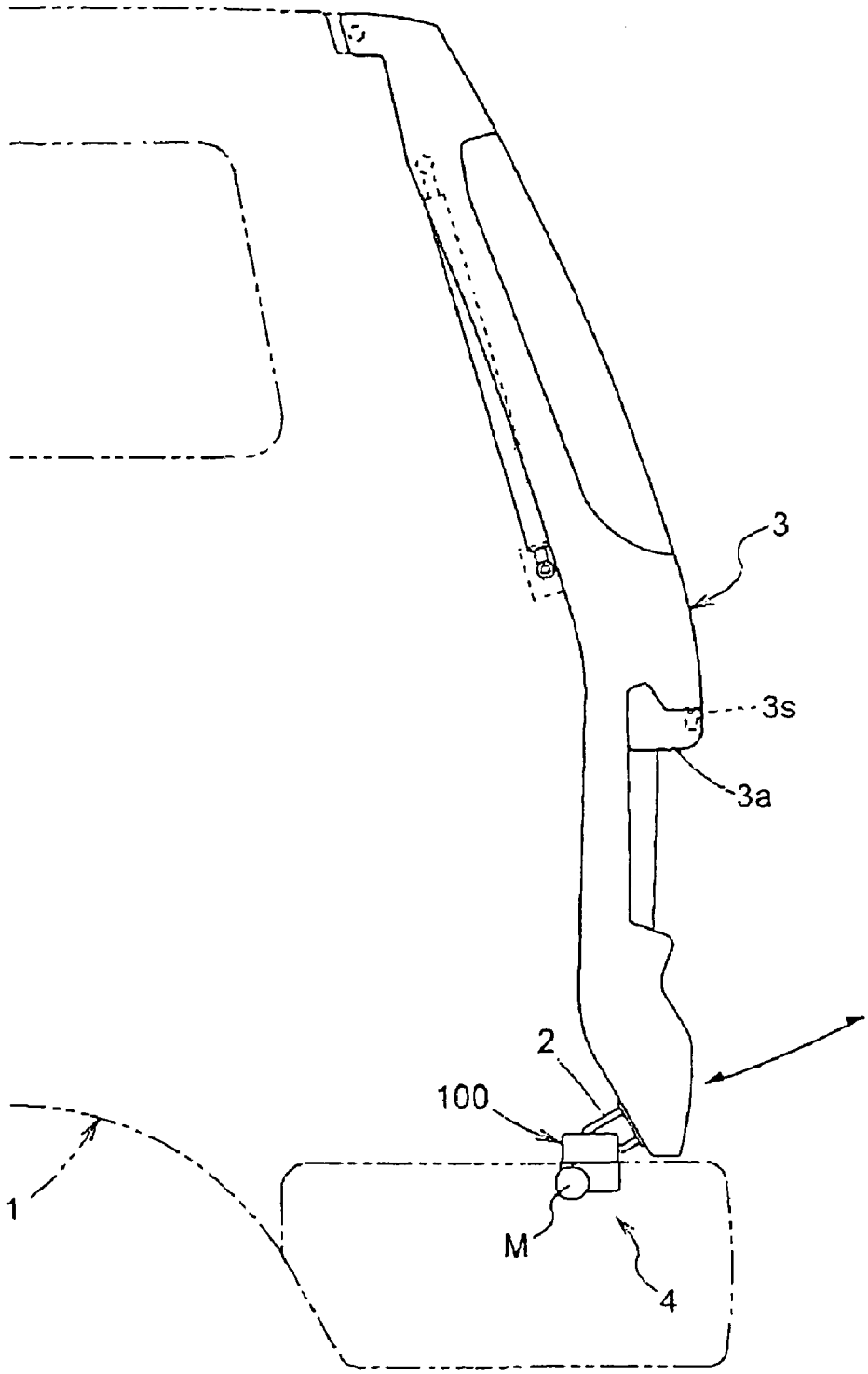
FIG. 1 is a side view of a rear portion of a vehicle equipped with a vehicle door lock device according to an embodiment of the present invention.
Figure 2:
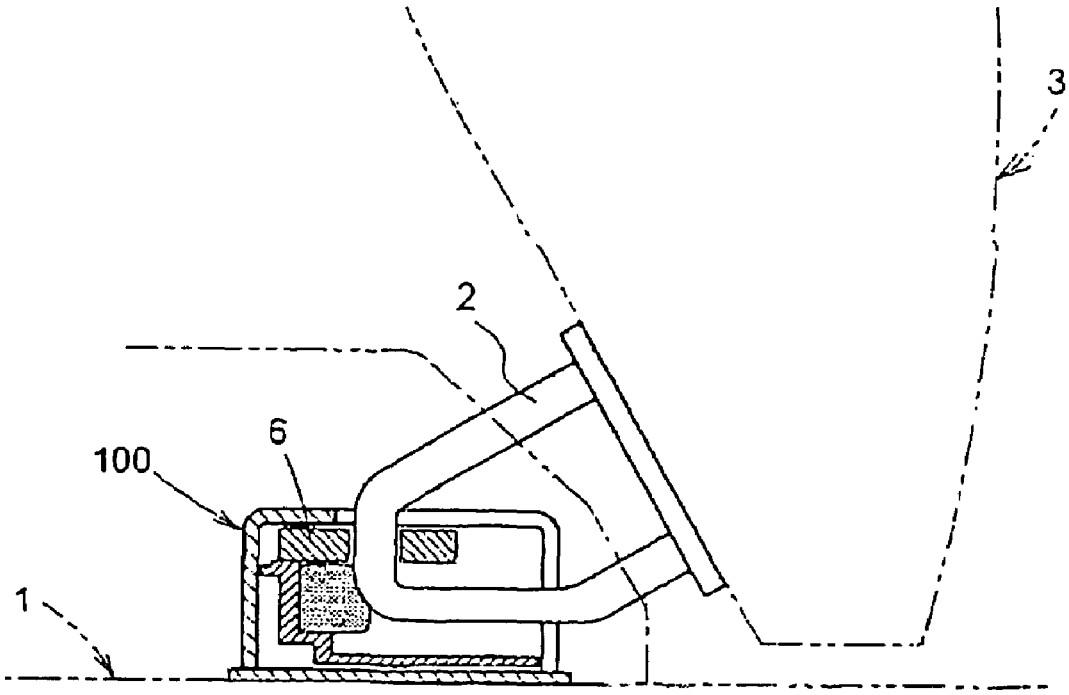
FIG. 2 is a cross-sectional view of the vehicle door lock device in a full-latched state.
Figure 3:
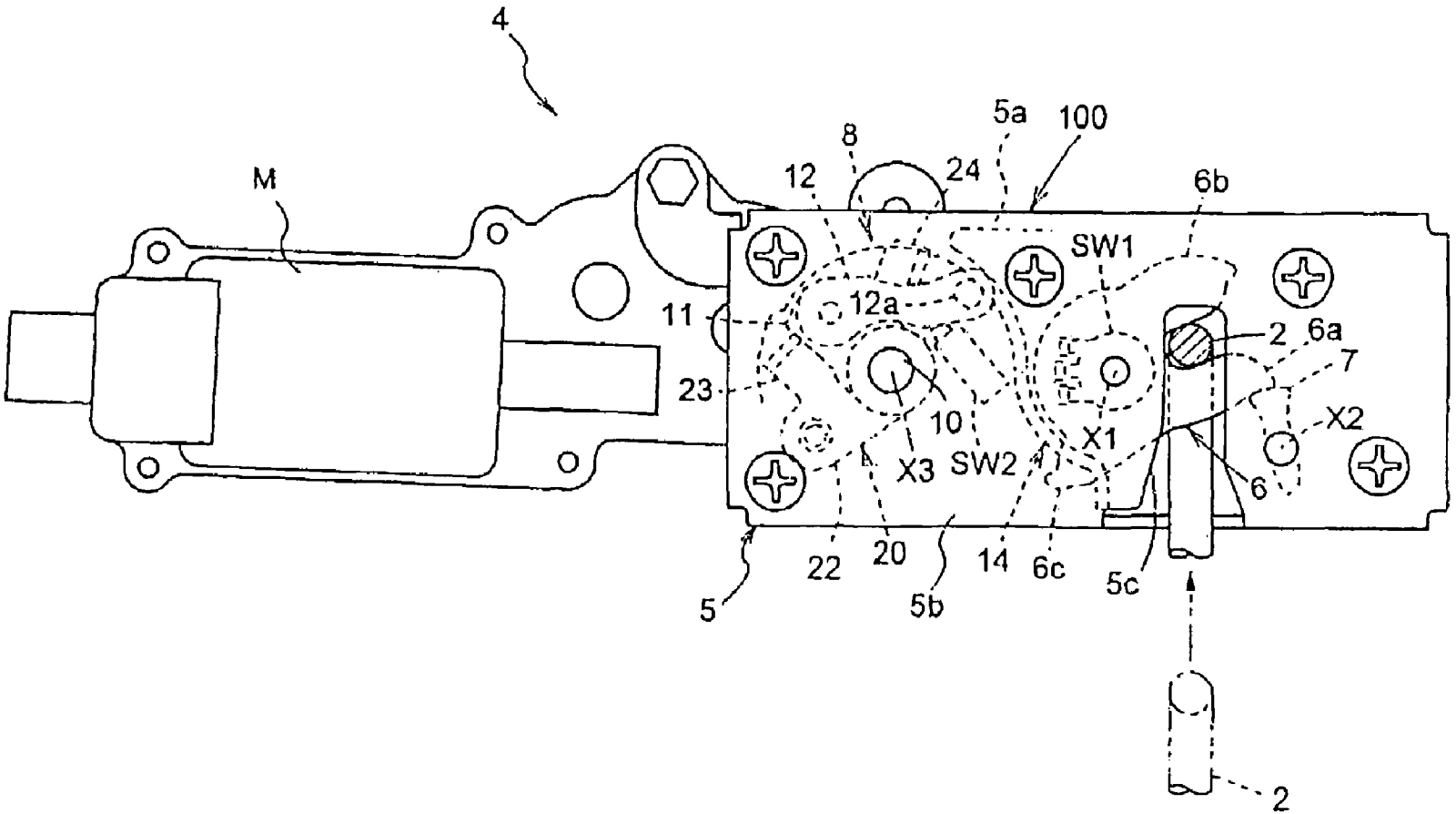
FIG. 3 is a plain view of the vehicle door lock device of FIG. 1.
Figure 4:
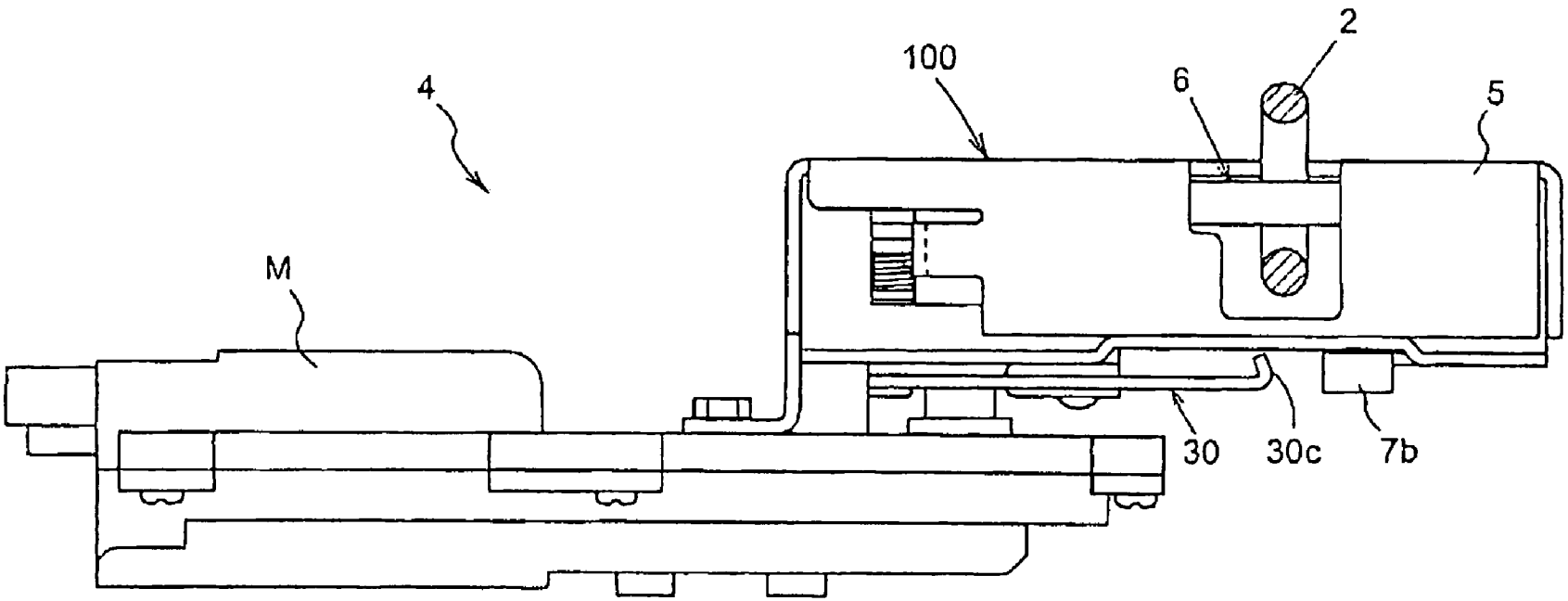
FIG. 4 is a front view of the vehicle door lock device of FIG. 1.
Figure 6:
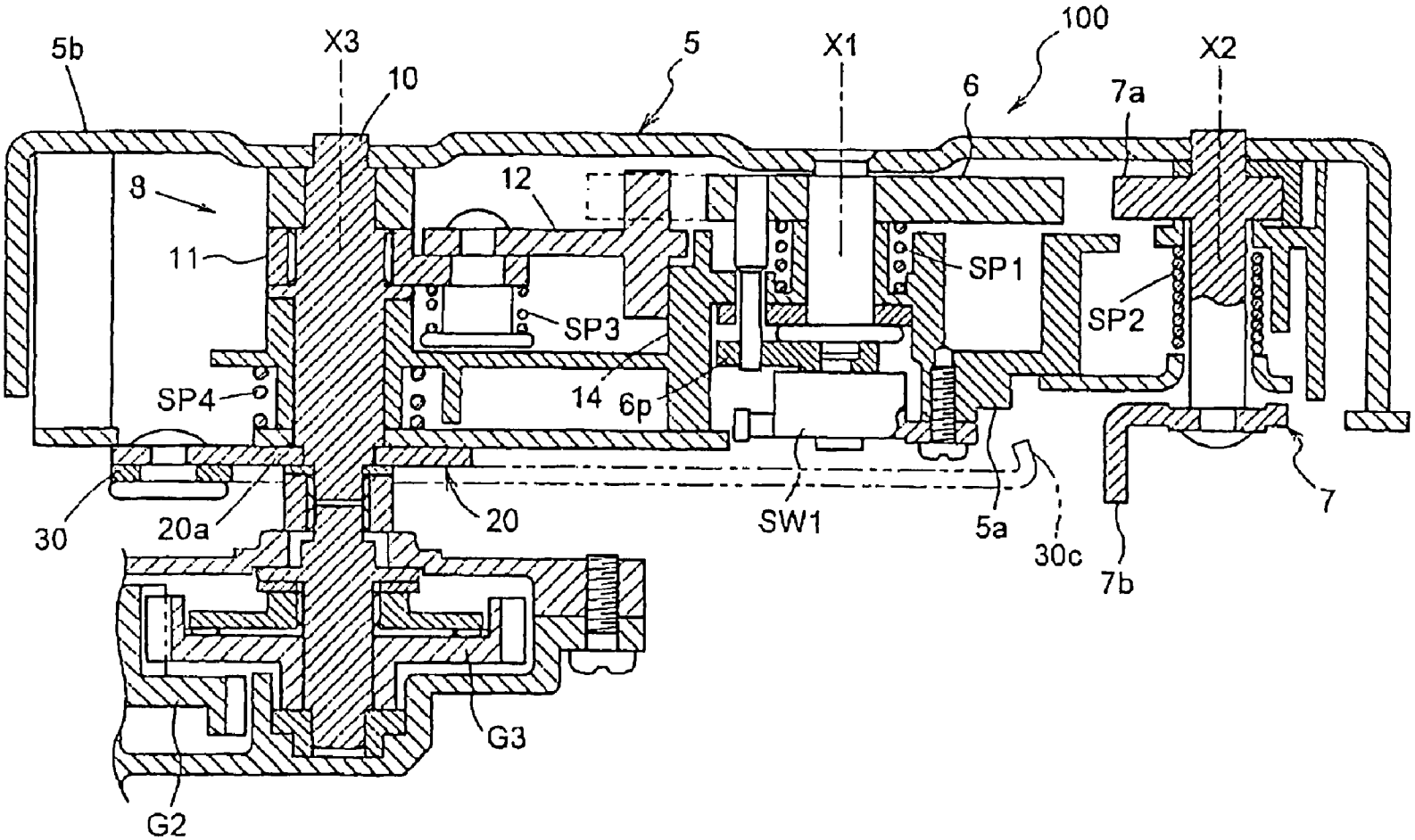
FIG. 6 is a cross-sectional view showing a portion of the vehicle door lock device of FIG. 4.

An embodiment of the present invention is explained referring to attached drawings. FIGS. 1 and 2 show a door opening/closing mechanism 100 disposed between a body 1 and a door 3 (back door in the present embodiment) of a vehicle. The door opening/closing mechanism 100 includes a striker 2 provided at the door 3 and a door lock device 4 provided in the vicinity of a rear edge portion of a floor of the body 1 as shown in FIG. 1. An open handle 3*a* is provided at an outboard side of the door 3. As shown in FIG. 3, the door lock device 4 includes a synthetic-resin housing 5, a plate-shaped latch 6 that can pull the striker 2 into the body 1 side, a pawl 7 for restricting a rotation of the latch 6, and a lock operation mechanism 8 (actuator) for locking or unlocking the door 3 via a motor-powered operation of the latch 6 and the pawl 7. The housing 5 includes a housing body 5*a* and a base 5*b* for covering the housing body 5*a* from an upper side of the vehicle as shown in FIG. 6 in detail. A concave portion 5*c* is formed on the base 5*b* for receiving the striker 2.

As shown in FIGS. 3 to 6, the latch 6 is rotatable supported on a shaft X1 provided perpendicularly on the base 5*b* of the housing 5. The latch 6 is biased in an arrow A1 direction by a coil spring SP1 and the like having a relatively strong biasing force toward a home position HP1

Figure 7:
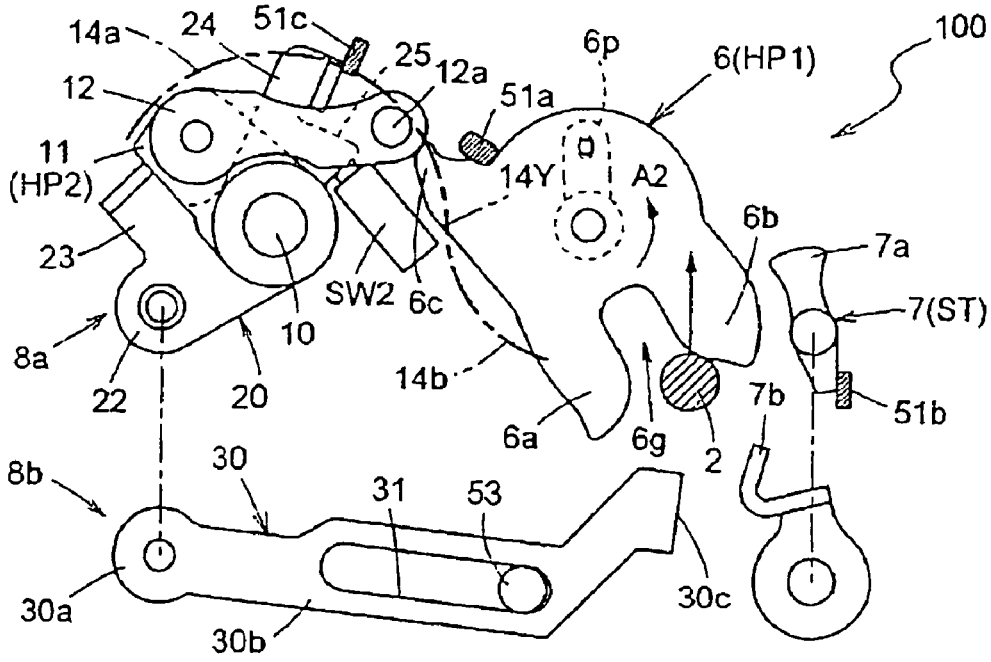
FIG. 7 is a view for explaining a process of a door lock operation (and a door unlock operation)

(state in FIG. 7, i.e. an example of open position). The latch 6 includes a first projection 6*a* provided close to an outer side of the body 1, i.e. on a side close the door 3, and a second projection 6*b* provided close to an inner side of the body 1, i.e. on a side away from the door 3. An engaging groove 6*g* for receiving the striker 2 is formed between the projections 6*a* and 6*b*. In addition, a half-engaging face 6*h* is formed on an inner side of the second projection 6*b*, i.e. a side close to the engaging groove 6*g*, of the latch 6 and pressed against an operating piece 7*a* of the pawl 7 in a half-latched position (an example of a lock position). In addition, a full-engaging face 6*f* is provided on an outer side of the first projection 6*a*, i.e. a side close to the door 3, and pressed against the operating piece 7*a* of the pawl 7 in a full-latched position (another example of the lock position). The latch 6 further includes a third projection 6*c* (operated portion) for receiving the lock operation by a closure arm 12 of the lock operation mechanism 8 (to be explained later). The third projection 6*c* is formed with an engaged concave portion 6*k* with which an operating pin 12*a* (to be explained later) is engageable. In the home position HP1, the third projection 6*c* is pressed against a cushion-shaped stopper 51*a* provided on the housing body 6*a* by a biasing force of the coil spring SP1.

A detected piece 6*p* (see FIG. 6) is provided at the latch 6, being integrally rotatable therewith for detecting a rotation status of the latch 6 as a rotation status detecting mechanism. A rotary switch SW1 (see FIG. 6) is provided on the housing body 5*a* for electrically detecting the detected piece 6*p*. The rotary switch SW1 includes a first contact Q1 for detecting the latch 6 in the half-latched state, a second contact Q2 for detecting the latch 6 in the full-latched state, and a third contact, Q3 for grounding. The pawl 7 is rotatably supported on a shaft X2, which is substantially perpendicularly provided on the base 5*b*, between a first position ST (see FIG. 5) and a second position RT (see FIG. 13). In the first position ST, the operating piece 7*a* of the pawl 7 is positioned within a rotation locus of the first projection 6*a* or the second projection 6*b*. In the second position RT, the operating piece 7*a* is not positioned within the rotation locus of the first projection 6*a* or the second projection 6*b*. The pawl 7 is biased to return to the first position ST by a biasing force of a coil spring SP2. In the first position ST, the operating piece 7*a* is in contact with the half-engaging face 6*h* or the full-engaging face 6*f* to thereby prevent the latch 6 from returning to the home position HP1. In the second position RT, the latch 6 is permitted to return to the home position HP1. Further, in the first position ST, an end portion of the pawl 7 provided on an opposite side to the operating piece 7*a* with respect to the shaft X2 is pressed against a stopper 51*b* provided on the housing 5 by the biasing force of the coil spring SP2. An operated piece 7*b* is also arranged on radially outer side relative to the operating piece 7*a* with respect to the shaft X2.

The lock operation mechanism 8 includes a closing mechanism 8*a* for the lock operation of the door 3 and an opening mechanism 8*b* for the unlock operation of the door 3. The lock operation mechanism 8 also includes an origin switch SW2 (detecting means) provided on the housing body 5*a* for controlling a switching between the lock operation and the unlock operation. The closing mechanism 8*a* includes a first swing lever 11 (first swing member) rotatably supported on a shaft X3 provided on the base 5*b* and the closure arm 12 (second saving member) rotatably connected to a vicinity of a tip portion of the first swing lever 11 via a pin. The operating pin 12*a* (operating portion) extending substantially parallel to the shaft X3 is integrally formed on a vicinity of a tip portion of the closure arm 12. In addition, a smooth guide face 14 (guide face, i.e. a drive mechanism) is provided on the housing body 5*a* for specifying a locus of the operating pin 12*a* in a predetermined shape. A coil spring SP3 (biasing member, i.e. the drive mechanism) is provided between the closure arm 12 and the first swing lever 11 for pushing the operating pin 12*a* toward the guide face 14 by biasing the closure arm 12 in a counterclockwise direction in FIG. 5. The first swing lever 11 is supported on a driving shaft 10, which is rotated in an arrow C1 or C2 direction by a rotation force transmitted from an electric motor M, such that the first swing lever 11 cannot rotate relative to the driving shaft 10. The rotation force of the electric motor M is transmitted to the driving shaft 10 via a worm gear fixed to a rotation shaft of the electric motor M, a third gear into which the driving shaft 10 is disposed, and a deceleration mechanism including a first gear and a second gear engaging with each other and arranged between the worm gear and the third gear. The third gear G3 and a portion of the second gear G2 are only shown in FIG. 6.

A biasing force of the coil spring SP3 disposed between the closure arm 12 and the first swing lever 11 is set to a sufficient level so that the operating pin 12*a* is constantly pressed against the guide face 14 regardless of a position of the lock operation mechanism 8 in the vehicle or a moving distance of the operating pin 12*a*. on the guide face 14. At the same time, if an object that prevents a sliding of the operating pin 12*a* on the guide face 14, such as a tip end portion of the third projection 6*c* of the latch 6, instead of the engaged concave portion 6*k*, is positioned in the vicinity of the guide face 14 due to a malfunction of a CPU caused by a noise and the like, the operating pin 12*a* is able to slide on the guide face 14 by detouring around the object, i.e. moving beyond the object so that the closure arm 12, the guide face 14 and the like are not damaged.

Figure 5:
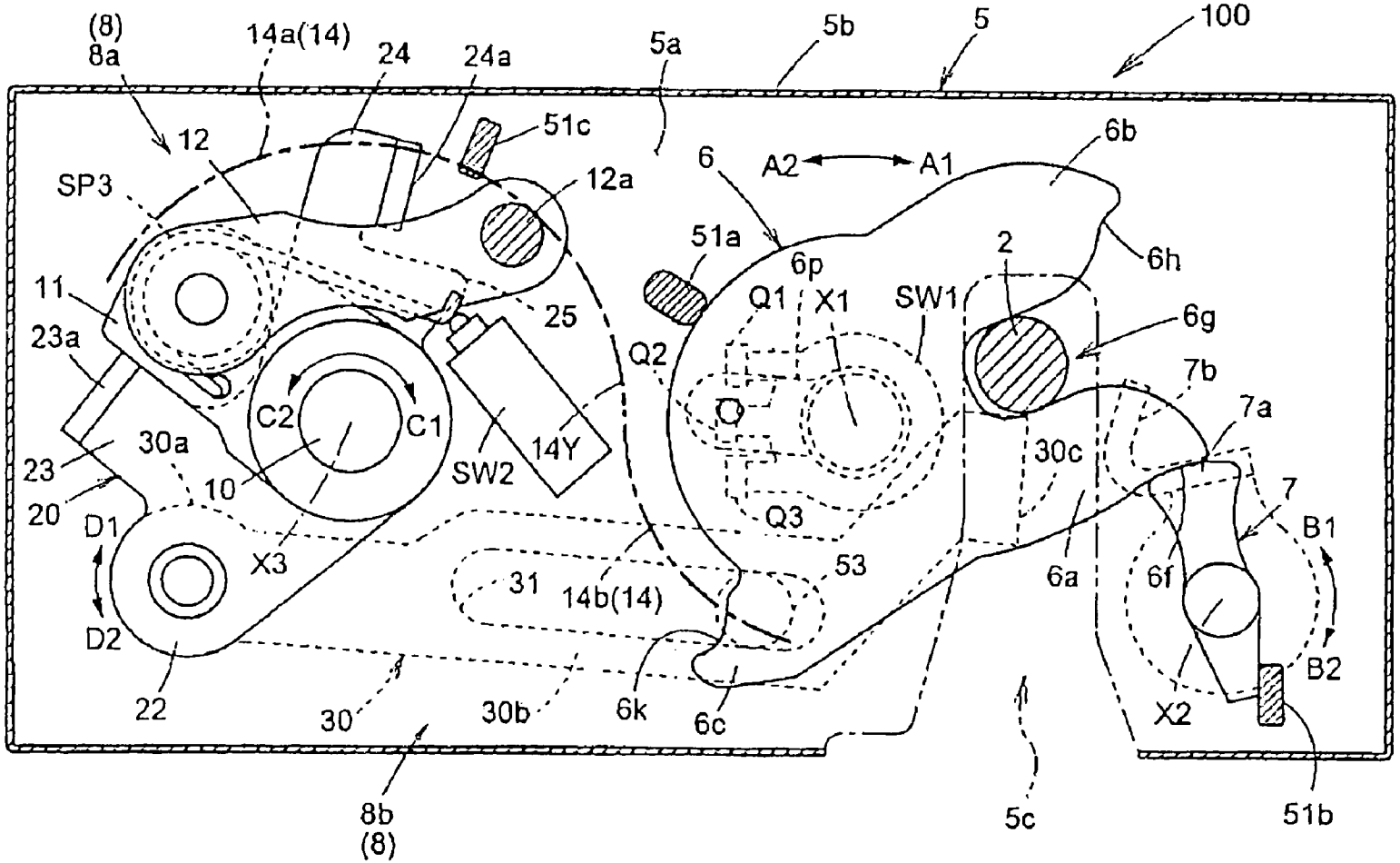
FIG. 5 is a front view showing a portion of the vehicle door lock device of FIG. 3.
Figure 11:
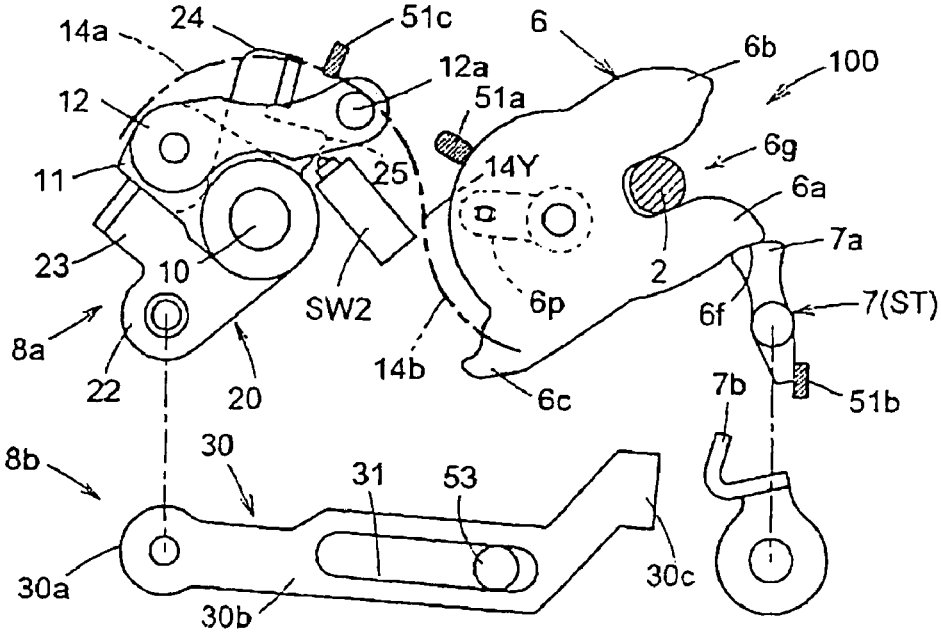
FIG. 11 is a view for explaining a process of the door lock operation (and the door unlock operation)

When the driving shaft 10 is kept rotating in the arrow C1 direction along with a normal rotation of the electric motor M, the first swing lever 11 is rotated as a unit with the driving shaft 10. Then, the operating pin 12*a* of the closure arm 12 is slid to move on the guide face 14 and engages with the engaged concave portion 6*k* formed on the third projection 6*c* of the latch 6, thereby rotating the latch 6 in an arrow A2 direction. The latch 6 becomes in a full-latched state as shown in FIGS. 5 and 11. The guide face 14 is formed by a first guide region 14*a* constituted by a portion of a first arc provided with respect to the shaft X3 and a second guide region 14*b* constituted by a portion of a second arc provided with respect to the shaft X1 being smoothly connected with each other via an inflection portion 14Y having a short (equal to or smaller than 5 mm, for example) or no length. A radius of the second arc forming the second guide region 14*b* (a portion of the guide face 4 for guiding the operating portion that has been completely engaged) is set to a value whereby the operating pin 12*a* is constantly positioned on the rotation locus of the engaged concave portion 6*k* of the latch 6 moving with respect to the shaft X1 as long as the operating pin 12*a* is positioned on the second guide region 14*b*. When the operating pin 12*a* is positioned on the inflection portion 14Y, the operating pin 12*a* faces extremely close to the engaged concave portion 6*k* or is slightly in contact therewith. A radius of the first arc forming the first guide region 14*a* is slightly larger than that of the second arc and does not overlap with the rotation locus of the engaged concave portion 6*k* of the latch 6 as long as the operating pin 12*a* is positioned on the first guide region 14*a* (for example, a state in FIG. 6) in which the inflection portion 14Y is excluded.

Figure 15:
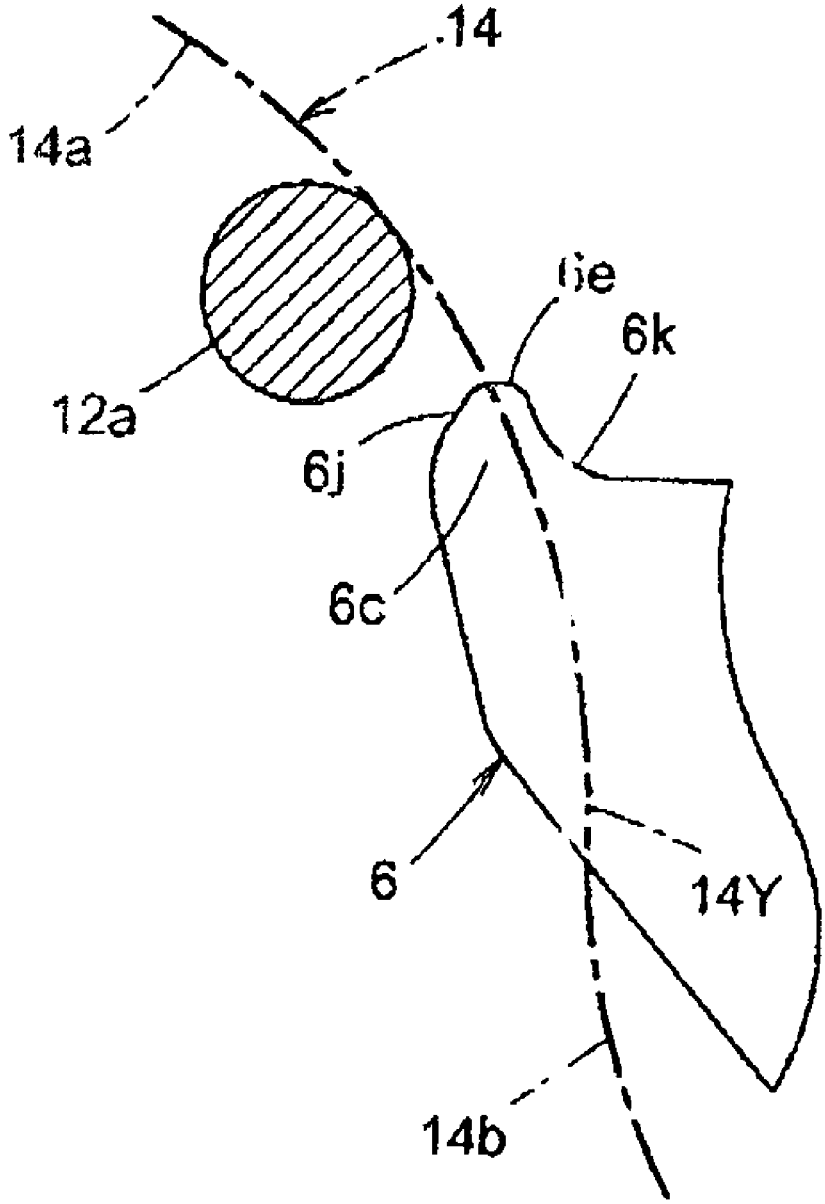
FIG. 15 is an enlarged view of a tip portion of a third projection of a latch.

As shown in FIG. 15, a first cam face 6*e* (auxiliary cam face) and a second cam face 6*j* (cam face) are formed on both sides of the tip end portion of the third projection 6*c* of the latch 6. When the latch 6 is in the home position and in a state to be rotated, the first cam face 6*e* inclines to an inner side of the guide face 14 while the second cam face 6*j* inclines to an outer side of the guide face 14. When the operating pin 12*a* moves on the guide face 14 toward the tip end portion of the third projection 6*c* in a state in which a rotation amount of the latch 6 is extremely insufficient for some unexpected reason, the second cam face 6*j* pushes the operating pin 12*a* in a direction in which the operating pin 12*a* is away from the guide face 14 (so that the operating pin 12*a* is prevented from hitting against the tip end portion of the third projection 6*c*) with the tip end portion of the third projection 6*c* in contact with a portion close to the guide face 14 on the outer peripheral face of the operating pin 12*a*. Alternatively, the third projection 6*c* of the latch 6 is pushed back to a position by being moved inward from the guide face 14 due to a cam operation of the second cam face 6*j*. Therefore, when the rotation amount of the latch 6 is extremely insufficient, the latch 6 and the operating pin 12*a* are prevented from engaging with each other so as not to enter the door lock operation mode. The parts are thus prevented from being damaged.

Meanwhile, when the operating pin 12*a* moves toward the tip end portion of the third projection 6*c* of the latch 6 in a state in which the rotation amount of the latch 6 is slightly insufficient due to some unexpected reason, the first cam face 6*e* engages with the operating pin 12*a* to thereby rotate the latch 6 in a state in which the operating pin 12*a* is received within the engaged concave portion 6*k* with the tip end portion of the third projection 6*c* in contact with a portion away from the guide face 14 on the circumferential face of the operating pin 12*a*. Thus, the normal door lock operation can be returned when the rotation amount of the latch 6 is slightly insufficient.

The opening mechanism 8*b* includes an unlock plate 20 slidably supported on the shaft X3. The unlock plate 20 is supported on the driving shaft 10 so as to rotate relative thereto, which is a different condition from the first swing lever 11. The unlock plate 20 is biased in an arrow D1 direction in FIG. 5 by a coil spring SP4 disposed between the unlock plate 20 and the housing body 5*a*. As shown in FIGS. 5 and 6, the unlock plate 20 includes a supported portion 20*a* supported by the driving shaft 10 and from which a second swing lever portion 22 and a first control lever portion 24 extend as a unit with the supported portion 20*a* in different directions from each other. A release arm 30 is rotatably connected to a vicinity of a tip portion of the second swing lever portion 22 via a pin for releasing the pawl 7, i.e. disengaging the pawl 7 from the latch 6. As shown in FIG. 7, the release arm 30 includes a base end portion 30*a* rotatably supported on the second swing lever portion 22, a middle portion 30*b* extending in a transverse direction in FIG. 7 from the base end portion 30*a*, and an operating portion 30*c* extending obliquely upward from the middle portion 30*b*. A guide hole 31 is formed on the middle portion 30*b* and in which a control pin 53 perpendicularly formed on the housing body 5*a* is positioned. Thus, a link mechanism is constituted by the base end portion 30*a* of the release arm 30 rotatably supported on the second swing lever portion 22 and the guide hole 31 whose moving area is restricted only in a substantially transverse direction in FIG. 7 by the control pin 53. When the unlock plate 20 is rotated in an arrow D2 direction (i.e., counterclockwise direction) in FIG. 6, the operating portion 30*c* of the release arm 30 is moved to the pawl 7 side according to the link mechanism.

In addition, as shown in FIG. 5, a second control lever portion 23 extends laterally and integrally from a vicinity of a base end portion of the second swing lever portion 22. An operated piece 23*a* engageable with the first swing lever 11 of the closing mechanism 8*a* is perpendicularly formed on an edge portion of the second control lever portion 23. When the driving shaft 10 is rotated in the arrow C2 direction due to a reverse rotation of the electric motor M, the first swing lever 11 rotated in the same direction, i.e. the arrow C2 direction, pushes and operates together with the operated piece 23*a*. Then, the unlock plate 20 is rotated in the arrow D2 direction by overcoming the biasing force of the coil spring SP4. Finally, the release arm 30 releases the pawl 7, i.e. disengages the pawl 7 from the latch 6.

A restricted piece 24*a* is formed perpendicularly in the vicinity of a tip portion of the first control lever portion 24. Then, a cushion-shaped stopper 51*c* is provided on the housing body 5*a*, being partially positioned within the rotation locus of the restricted piece 24*a*. That is, the rotation of the unlock plate 20 by the coil spring SP4 in the D1 direction is restricted by the restricted piece 24*a* being in contact with the stopper 51*c*.

A switch operating portion 25 for pressing the origin switch SW2 extends laterally frolic a vicinity of the base end portion of the first control lever portion 24 as shown in FIG. 5. A position relationship between the origin switch SW2 and the switch operating portion 25 is that the switch operating portion 25 presses the origin switch SW2 to turn in ON status immediately before the restricted piece 24*a* of the first control lever portion 24 becomes in contact with the stopper 51*c* while the unlock plate 20 is rotated in the D1 direction.

Figure 14:
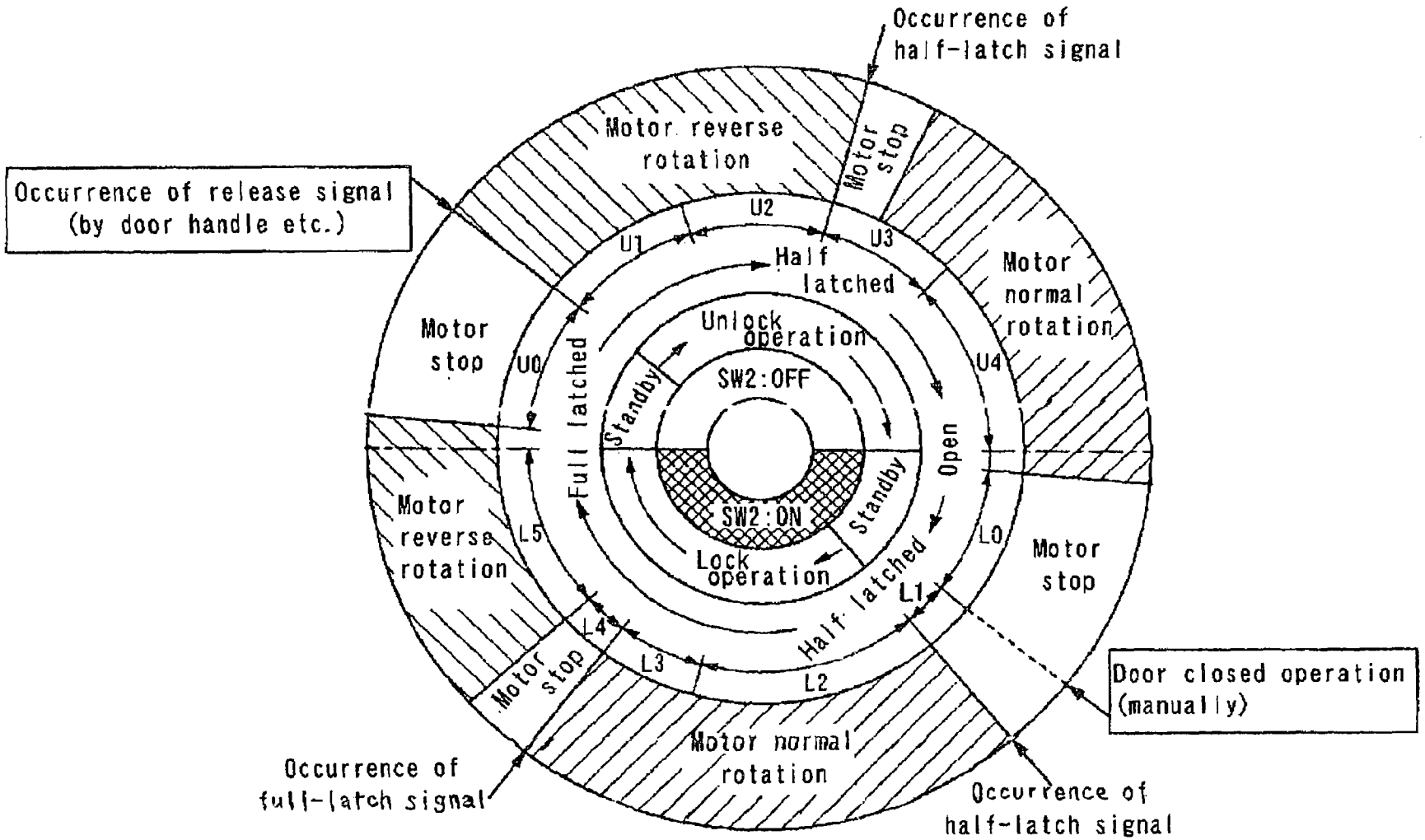
FIG. 14 is a view for explaining each process of the door lock operation and the door unlock operation.

Next, the lock operation and the unlock operation by the door opening/closing mechanism 100 are explained as follows based on main processes. FIG. 14 is a diagram showing each status of the latch 6 (open, half-latch, or full-latch), the electric motor M (normal rotation, reverse rotation or stop), and the origin switch SW2 (ON or OFF) in each operation of the door 3 based on the passage of time. Each process (L0 to L5, and U0 to U4) is indicated radially inner side of a ring showing a status of the electric motor M. A length in a circumferential direction of each process, however, does not correspond to time required for an actual situation.

The lock operation of the door 3 by the closing mechanism 8*a* of the door opening/closing mechanism 100 is performed based on each process mentioned below.

L0 (As Shown in FIG. 14): Door Open State

When the door 3 is open, the latch 6 is in the home position HP1 in which the third projection 6*c* of the latch 6 is pressed against the stopper 51*a*. The pawl 7 is in the first position ST in which the end portion of the pawl 7 provided opposite side to the operating piece 7*a* with respect to the shaft X2 is pressed against the stopper 51*b*. The first swing lever 11 of the closing mechanism 8*a* is stopped in a position whereby the switch operating portion 25 of the unlock plate 20 keeps the origin switch SW2 in ON status (i.e. home position HP2). At this time, the restricted piece 24*a* of the first control lever portion 24 can be pressed against the stopper 51*c*. In addition, at this time, the operating pin 12*a* of the closure arm 12 is positioned out of the rotation locus of the third projection 6*c* of the latch 6. This state is a preliminary step before the substantial door lock operation is initiated. The substantial door lock operation is initiated from a next process.

L1 (As Shown in FIG. 14): Obtaining the Half-latched State

Figure 8:
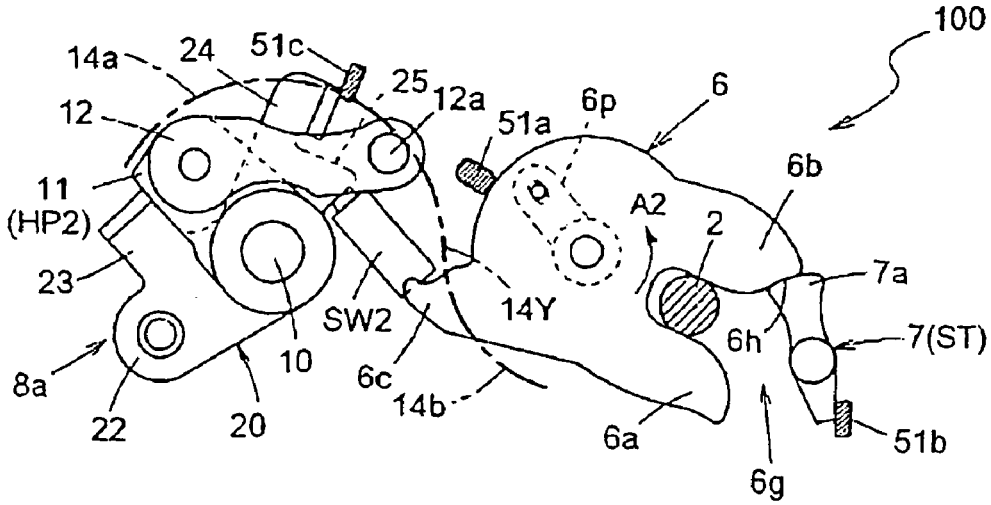
FIG. 8 is a view for explaining a process of the door lock operation.

When the user slightly manually closes the door 3 from the door open state mentioned above, the second projection 6*b* of the latch 6 is pushed by the striker 2 of the door 3 to thereby rotate the latch 6 in the A2 direction by overcoming the biasing force of the coil spring SP1. The second projection 6*b* is kept rotating to push the pawl 7 toward the second position RT. Finally when the second projection 6*b* is once positioned above the operating piece 7*a* of the pawl 7, the latch 6 becomes in the half-latched state by the pawl 7 returning to the first position ST and the operating piece 7*a* of the pawl 7 engaging with the half-engaging face 6*h* as shown in FIG. 8. At this time, the detected piece 6*p* of the latch 6 is detected by the first contact Q1 of the rotary switch SW1. An electrical signal indicating the half-latched state (in the door lock operation) (indicated as "occurrence of the half-latch signal" in FIG. 14) is sent from the rotary switch SW1 and received by the CPU provided in an ECU (electronic control unit mounted in the vehicle), which then sends the control signal to the electric motor M to rotate the motor in the normal rotation direction.

L2 (As Shown in FIG. 14): Staring to Pull the Striker into the Latch

Figure 9:
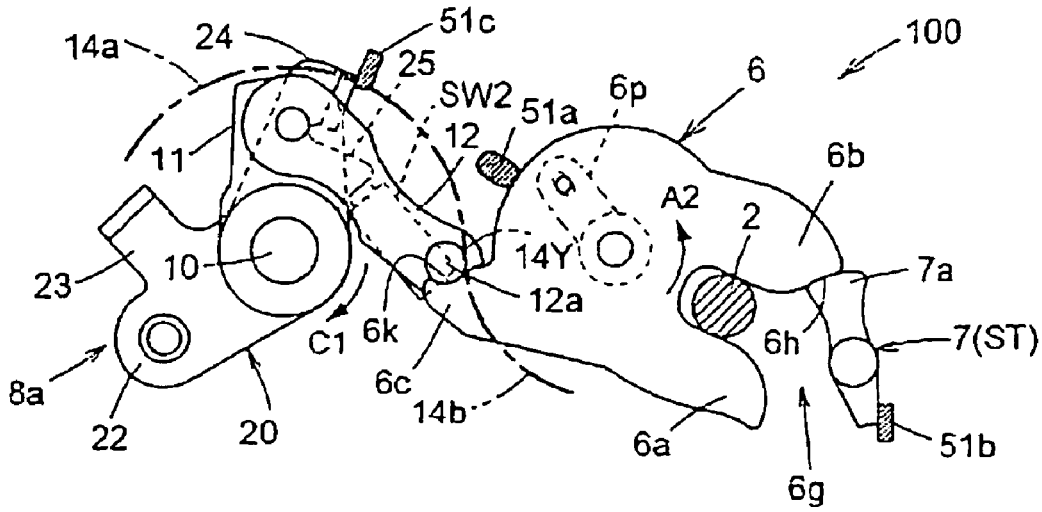
FIG. 9 is a view for explaining a process of the door lock operation.

When the first swing lever 11 is rotated in the C1 direction (clockwise direction) together with the driving shaft 10 from the home position HP2 due to the normal rotation of the electric motor Mf that has been started at the end of the L1 process, the operating pin 12*a* of the closure arm 12 is slid to move on the guide face 14. The operating pin 12*a* engages with the third projection 6*c* of the latch 6 in a position where the operating pin 12*a* just passes over the infection region 14Y. Then, as shown in FIG. 9, the operating pin 12*a* is kept sliding on the second guide region 14*b*, thereby rotating the latch 6 in the A2 direction. As a result, the striker 2 engaged within the engaging groove 6*g* starts to be pulled into the concave portion 5*c* of the housing 5.

L3 (As Shown in FIG. 14): Full-latch Preparing State

When the first swing lever 11 is kept rotating by the normal rotation of the electric motor M and the operating pin 12*a* is slid on a last half portion of the second guide region 14*b* to thereby rotate the latch 6 in the A2 direction, the first projection 6*a* of the latch 6 then rotates the pawl 7 towards the second position RT. Finally, when the first projection 6*a* is once positioned above the operating piece 7*a* of the pawl 7, the latch 6 becomes in the full-latch preparing state by the pawl 7 returning to the first position ST and the operating piece 7*a* of the pawl 7 facing the full-engaging face 6*f*. The first swing lever 11 is still kept rotating by the normal rotation of the electric motor M to the next process. The full-latch preparing step is included in the full-latch state in the broad sense.

L4 (As Shown in FIG. 14): Over-stroke Process

Figure 10:
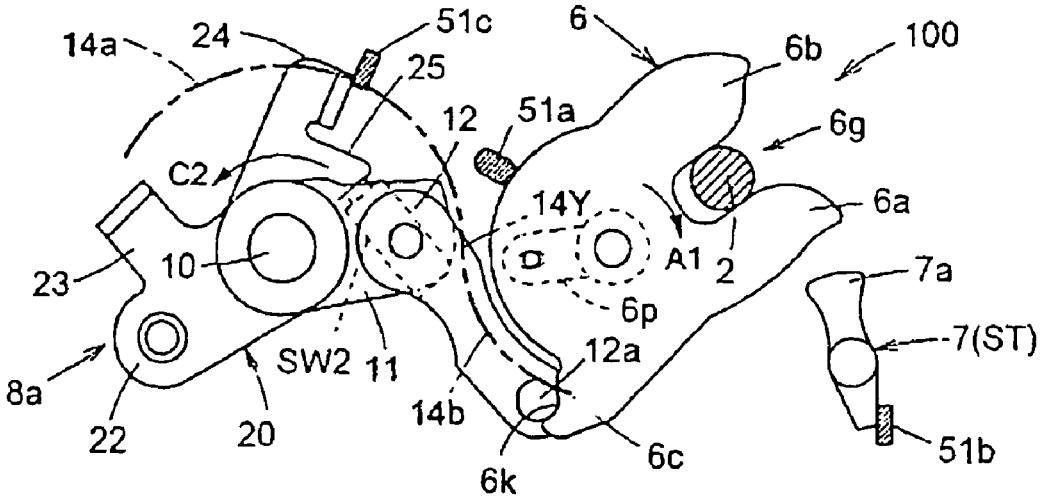
FIG. 10 is a view for explaining a process of the door lock operation.

When the first swing lever 11 is kept rotating by the normal rotation of the electric motor M and the operating pin 12*a* is slid on the last half portion of the second guide region 14*b* to thereby further rotate the latch 6 in the A2 direction, the over-stroke process in which the first projection 6*a* of the latch 6 becomes once separated from the operating piece 7*a* is obtained as shown in FIG. 10. At this time, the detected piece 6*p* is detected by the second contact Q2 of the rotary switch SW1. Then, an electrical signal indicating the full-latched state is sent from the rotary switch SW1 and received by the CPU, which then stops the motor M once. Then the motor M sends the control signal for rotating the electric motor M in the reverse rotation direction. The over-stroke process is included in the full-latched state in the broad sense.

L5(As Shown in FIG. 14): Return Process of the Closing Mechanism to the Original Position The first swing lever 11 is started to be rotated in the C2 direction due to the reverse rotation of the electric motor M. When the operating pin 12*a* returns to move slightly on the second guide region 14*b* toward the first guide region 14*a*, the latch 6 is rotated in the A1 direction by the biasing force of the coil spring SP1, thereby obtaining the actual full-latched state (not shown) in which the first projection 6*a* is ill contact with the operating piece 7*a* of the pawl 7 again and the operating pin 12*a* is separated from the third projection 6*c* of the latch 6. Next, the reverse rotation of the electric motor M is further continued and thus the operating pin 12*a* enters into the first guide region 14*a*. Finally, when the first swing lever 11 presses the second control lever portion 23 slightly in the D2 direction, the restricted piece 24*a* of the first control lever portion 24 becomes slightly separated from the stopper 51*c* as shown in FIG. 11. The switch operating portion 25 turns the origin switch SW2 in OFF status subsequently. The CPU stops the electric motor M based on the signal output from the origin switch SW2 (indicating completion of the lock operation) at a time of the origin switch SW2 turned in OFF status. Then, the CPU enters into a standby mode.

In the standby mode, the unlock plate 20 may be constituted to be further pushed in the D2 direction by the overrun of the first swing lever 11 and stopped in a position whereby the switch operating portion 25 becomes separated from an operated piece of the origin switch SW2 during a time-lag (that may correspond to an overrun of the electric motor M) from a time of the origin switch SW2 turned in OFF status to a time of the electric motor M actually stopped. In this case, however, if the switch operating portion 25 is widely separated from the origin switch SW2, the following unlock operation by the opening mechanism 8*b* is slightly delayed to start. Therefore, the overrun amount is desirably reduced so that the distance between the switch operating portion 25 and the origin switch SW2 is minimized. In the standby mode, it should be noted that the operating pin 12*a* of the closure arm 12 is positioned out of the rotation locus of the third projection 6*c* of the latch 6.

The unlock operation of the door 3 by the opening mechanism 8*b* of the door opening/closing mechanism 100 is performed according to each process in the following.

U0(As Shown in FIG. 14): Door Closed State

When the door 3 is closed, the door opening/closing, mechanism 100 is in the same state as a final stage of the L5: return process of the closing mechanism to the original position as shown in FIG. 11. That is, the latch 6 is in the full-latched state as the full-engaging face 6*f* is pressed against the operating piece 7*a* of the pawl 7. In addition, the first swing lever 11 of the closing mechanism 8*a* presses the second control lever portion 23 in the D2 direction to thereby obtain a small clearance between the restricted piece 24*a* of the first control lever portion 24 and the stopper 51*c*. That is, the origin switch SW2 is not pressed by the switch operating portion 25 of the unlock plate 20 and is in OFF status. This state is a preliminary step before the door unlock operation is actually initiated. The substantial door unlock operation is initiated from a next process.

U1(As Shown in FIG. 14): Staring Operation of the Release Arm 30

Figure 12:
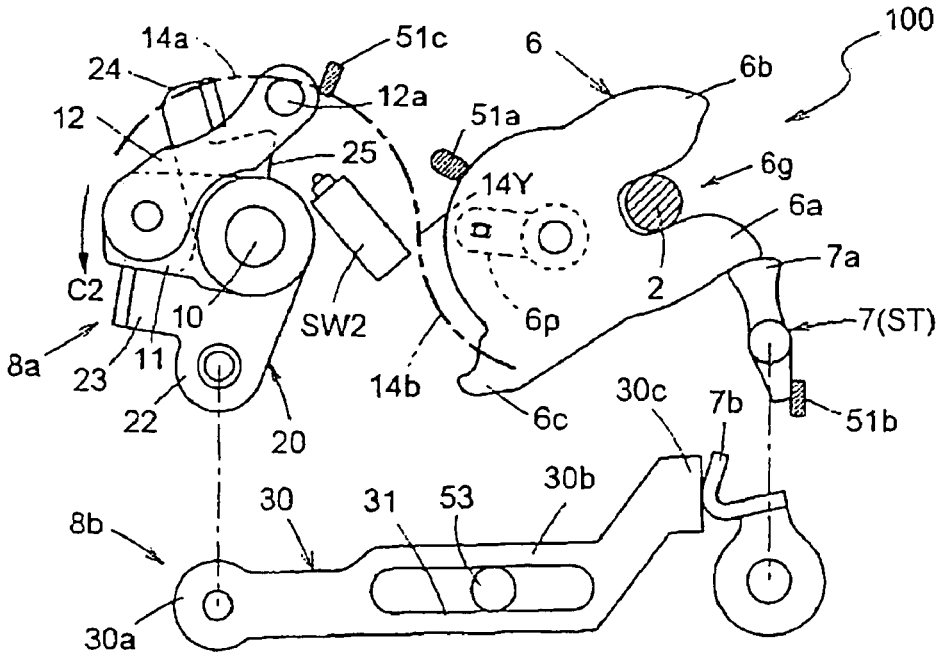
FIG. 12 is a view for explaining a process of the door unlock operation.

When the open handle 3*a* provided at the outside of the door 3, an open lever (not shown) provided at a driver seat or the like is operated from the above-mentioned state, the release signal (shown as "occurrence of release signal" in FIG. 14) is sent to the CPU from the microswitch 3*s* operated together with the open handle 3*a*. The CPU then sends a control signal for rotating the electric motor M in the reverse rotation direction. The first swing lever 11 is rotated in the C2 direction (counterclockwise direction) from the home position HP2 side as shown in FIG. 12. Then, the second control lever portion 23 of the unlock plate 20, which engages with the first swing lever 11 via the operated piece 23*a,* is moved in the D2 direction, thereby moving the release arm 30 rotatably connected to the second swing lever portion 22 toward the pawl 7 by the aforementioned link mechanism.

U2(As Shown in FIG. 14): Releasing of the Pawl 7

The operating portion 30*c* of the release arm 30 starts to be in contact with the operated piece 7*b* of the pawl 7 to thereby rotate the pawl 7 in a B2 direction as the reverse rotation of the electric motor M is continued. When the pawl 7 is moved to the second position RT, the operating piece 7*a* of the pawl 7 becomes out of the rotation locus of the first projecting 6*a* of the latch 6. Thus, the latch 6 is disengaged and released from the pawl 7 and started to return to the A1 direction toward the home position HP1. This returning process of the latch 6 is performed at the same time as the latch 6 brings the striker 2 to be outwardly withdrawn from the concave portion 5*c* of the base 5*b* by the biasing force of the coil spring SP1.

U3(As Shown in FIG. 14): Obtaining the Half-latched State

Figure 13:
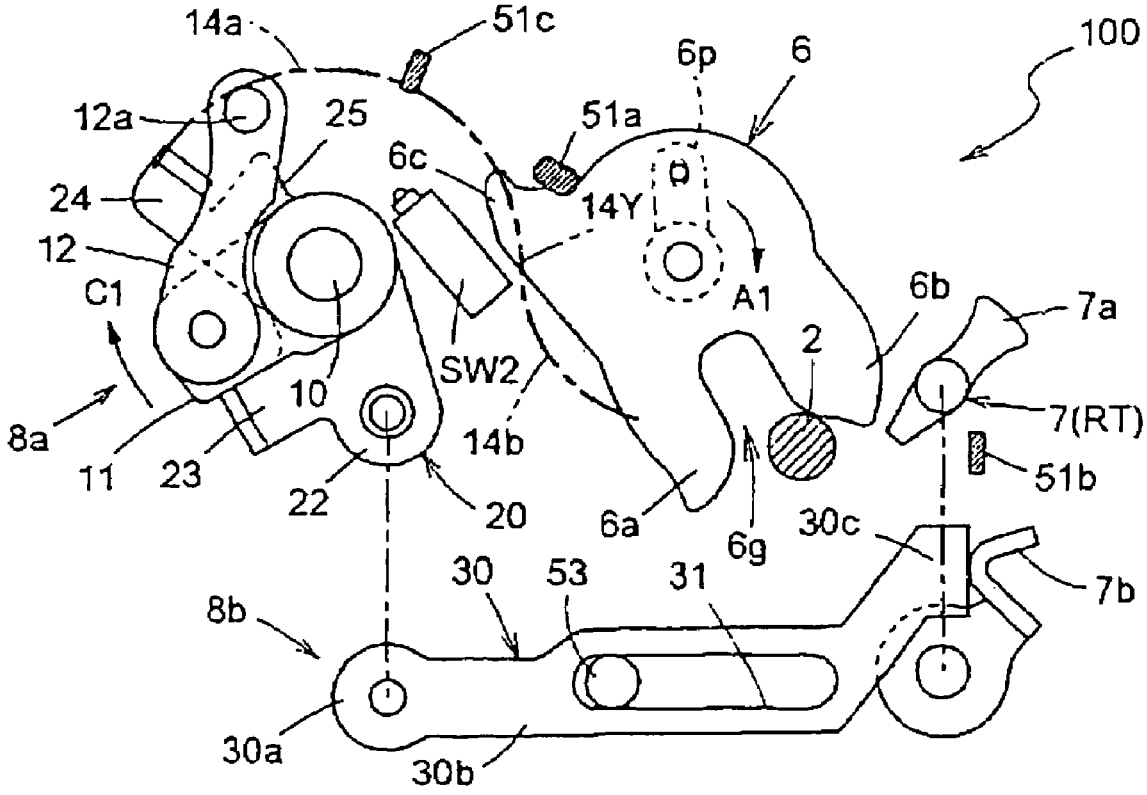
FIG. 13 is a view for explaining a process of the door unlock operation.

When the latch 6 reaches the half-latched position during the above-mentioned returning process, the detected piece 6*p* of the latch 6 is detected by the first contact Q1 of the rotary switch SW1. Then, as shown in FIG. 14, an electrical signal indicating the half-latched state (in the door unlock operation) is sent from the rotary switch SW1 and received by the CPU, which then once stops the electric motor M and sends a control signal for rotating the motor M in the normal rotation direction. The first swing lever 11 is therefore rotated in the C1 direction (clockwise direction) as well as the unlock plate 20 pressed against the first swing lever 11 via the operated piece 23*a* is rotated in the D1 direction (clockwise direction). The release arm 30 starts to be separated from the pawl 7. FIG. 13 shows a moment when the latch 6 reaches the home position HP1 in which the latch 6 pushes the striker 2 toward an opening end portion, i.e. a portion close to the door 3, of the concave portion 5*c* of the base 5*b* with the motor M in a stopped state.

U4(As Shown in FIG. 14): Return Process of the Opening Mechanism to the Original Position When the motor M is kept rotating in the normal rotation direction, the unlock plate 20 rotated in the D1 direction together with the first swing lever 11 finally pushes the origin switch SW2 to turn in ON status via the switch operating portion 25 (same state as shown in FIG. 7). The CPU stops the motor M based on the signal output from the origin switch SW2 (indicating completion of the unlock operation) at a time of the origin switch SW2 turned in ON status. Then, the CPU enters into the standby mode. At this time, as shown in FIG. 7, the unlock plate 20 may be returned to a state in which the restricted piece 24*a* of the first control lever portion 24 is pressed against the stopper 51*c* during a time-lag (that may correspond to the overrun of the electric motor M) from a time of the origin switch SW2 being pressed and turned in ON status to a time of the motor M actually stopped. If the first swing lever 11 is kept overrunning after the restricted piece 24*a* is pressed against the stopper 51*c,* however, the first swing lever 11 becomes not in contact with the operated piece 23*a* of the unlock plate 20 any more, thereby delaying the following lock operation to start by the closing mechanism 8*a*. Thus, the overrun amount is desirably reduced to a level by which the first swing lever 11 is kept engaging with the operated piece 23*a*. This structure may be achieved by setting a relative position between the restricted piece 24*a* and the stopper 51*c,* and a moving stroke of the operated piece of the origin switch SW2 such that the restricted piece 24*a* of the unlock plate 20 is just pressed against the stopper 51*c* when the unlock plate 20 is finally stopped, including the overrun, after the switch operating portion 25 turns the origin switch SW2 in ON status.

Alternatively, the overrun amount may he modified so that the first swing lever 11 is stopped before the restricted piece 24*a* of the first control lever portion 24 is pressed against the stopper 51*c*. In this case, the restricted piece 24*a* of the first control lever portion 24 is pressed against the stopper 51*c* by the coil sprint SP4 for the first time in the process of L2: starting to pull the striker into the latch when the first swing lever 11 is rotated in the C1 direction by the normal rotation of the motor M. In the aforementioned standby mode, it should be noted that the operating pin 12*a* of the closure arm 12 is positioned out of the rotation locus of the third projection 6*c* of the latch 6.

The embodiment of the present invention is not limited to the above but modified as follows. The release arm 30 may be rotatably supported on the first swing lever 11 instead of the unlock plate 20. In this case, the second swing lever portion 22 and the second control lever portion 23 may be detached from the unlock plate 20 of the present embodiment to be united with the first swing lever 11. Then, the release arm 30 may be rotatably supported on the second swing lever portion 22 that is united with the first swing lever 11. The unlock plate 20 may be formed with the first control lever portion 24 including the restricted piece 24*a* to be restricted by the stopper 51*c,* and the switch operating portion 25 for pressing the origin switch SW2. In this case, the moving plane of the first swing lever 11 and that of the release arm 30 may be required to be positioned different from each other for the door lock operation. Further, the guide hole 31 of the release arm 30 may be formed slightly longer in order to avoid bumping into the control pin 53.

Further, an emergency operation lever for permitting the latch 6 to return to the home position HP1 by forcedly rotating the pawl 7 in the arrow B2 direction may be provided at a vehicle inner side as a means for directly performing the unlock operation of the door 3 not via the door opening/closing mechanism 100.

According to the aforementioned embodiment, the striker 2 is provided at the door 3 and the door lock device 4 is provided at the body 1. However, contrary to the above, the striker 2 may be provided at the body 1 and the door lock device 4 may be provided at the door 3. In this case, a microswitch for sending the release signal to the CPU when the open handle is slightly operated can be provided at the open handle arranged at the outside of the door 3. Further, if the door unlock operation is not performed by the door opening/closing mechanism 100 due to a defect of the power supply from the battery in case that the user even operates the microswitch, the unlock operation of the door 3 can be performed by the pawl 7 connected to the open handle via a cable to be forcedly rotated in the B2 direction, which is caused by the open handle further widely operated. The door opening/closing mechanism 100 according to the present invention may be adopted not only to the back door as mentioned above but also a side door and the like.

The principles, preferred embodiment and mode of operation of the present invention have been described in the foregoing specification. However, the invention which is intended to be protected is not to be construed as limited to the particular embodiment disclosed. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A door lock device for a vehicle comprising:

a latch provided at one of a vehicle door and a vehicle-body and being rotatable between an open position in which the latch is disengageable from a striker provided at the other one of the vehicle door and the vehicle-body and a lock position in which the latch is prohibited to disengage from the striker;

an actuator for rotating the latch toward the lock position and including an operating portion engageable with an operated portion formed at the latch and a drive mechanism for moving the operating portion being in an engaged state with the operated portion along a predetermined path;

the drive mechanism including a guide wall face arranged so as to face the operating portion, a biasing member for biasing the operating portion to be pressed against the guide wall face, a first swing member rotated by a driving source, and a second swing member including the operating portion at a tip portion and supported on one end portion of the first swing member, which is rotatable with respect to the other end portion of the first swing member, the second swing member being rotatably biased by the biasing member, which comprises a spring member, in a predetermined direction relative to the first swing member; and the operating portion can be separated from the guide wall face by an external force greater than a biasing force of the biasing member.

2. A door lock device for a vehicle according to claim 1, wherein the first swing member and the second swing member keep a predetermined rotation angle therebetween at which the operating portion of the second swing member is constantly rotated ahead of the one end portion of the first swing member when the latch is rotated to the lock position.

3. A door lock device for a vehicle according to claim 2, wherein the operated portion of the latch includes an engaged concave portion for receiving the operating portion that has moved along the guide wall face.

4. A door lock device for a vehicle according to claim 3, wherein the latch includes a projecting portion in which the operated portion is included, and a cam face for guiding the operating portion in a direction in which the operating portion is away from the guide wall face when a tip end portion of the projecting portion becomes in contact with a portion close to the guide wall face on an outer peripheral face of the operating portion due to an insufficiency of a rotation amount of the latch.

5. A door lock device for a vehicle according to claim 4, wherein the biasing force of the biasing member is set to a predetermined level at which the operating member can overcome an obstacle positioned in a vicinity of the guide wall face by separating from the guide wall face.

6. A door lock device for a vehicle according to claim 5, wherein a portion of the guide wall face for guiding the operating portion that has been completed to engage with the operated portion of the latch extends in an arched-shape with respect to a shaft of the latch.

* * * * *